US005505260A

United States Patent [19]

Andersen et al.

[11] Patent Number: 5,505,260

[45] Date of Patent: Apr. 9, 1996

[54] METHOD AND APPARATUS FOR WELLBORE SAND CONTROL

[75] Inventors: Eric E. Andersen; Larry K. Moran; Richard M. Hodge; Nobuo Morita, all of Ponca City, Okla.

[73] Assignee: Conoco Inc., Ponca City, Okla.

[21] Appl. No.: 456,852

[22] Filed: Jun. 1, 1995

Related U.S. Application Data

[63] Continuation of Ser. No. 224,605, Apr. 7, 1994, abandoned.

[51] Int. Cl.[6] ..... E21B 43/04

[52] U.S. Cl. ..... 166/278; 166/51; 166/55; 166/100; 166/321; 166/383

[58] Field of Search ..... 166/51, 55, 100, 166/278, 297, 317, 321, 383, 386

[56] References Cited

U.S. PATENT DOCUMENTS

| | | | |
|---|---|---|---|
| 3,347,317 | 10/1967 | Zandmer | 166/100 |
| 3,468,386 | 9/1969 | Johnson | 175/4.6 |
| 3,818,986 | 6/1974 | Abney et al. | 166/51 |
| 3,826,310 | 7/1974 | Karnes | 166/276 |
| 3,939,927 | 2/1976 | Bohn | 175/4.52 |
| 4,285,398 | 8/1981 | Zandmer et al. | 166/100 |
| 4,428,428 | 1/1984 | Smyrl et al. | 166/278 |
| 4,522,264 | 6/1985 | McNeer | 166/278 |
| 4,566,538 | 1/1986 | Peterson | 166/55 X |
| 4,612,992 | 9/1986 | Vann et al. | 166/297 |
| 4,658,902 | 4/1987 | Wesson et al. | 166/317 |
| 5,165,478 | 11/1992 | Wilson | 166/297 |
| 5,224,556 | 7/1993 | Wilson et al. | 175/4.53 |
| 5,228,518 | 7/1993 | Wilson et al. | 166/369 |
| 5,346,016 | 9/1994 | Wilson et al. | 166/380 |

FOREIGN PATENT DOCUMENTS

| | | |
|---|---|---|
| WO95/09965 | 4/1995 | WIPO . |
| WO95/09966 | 4/1995 | WIPO . |
| WO95/09967 | 4/1995 | WIPO . |
| WO95/09968 | 4/1995 | WIPO . |

*Primary Examiner*—Roger J. Schoeppel
*Attorney, Agent, or Firm*—John E. Holder; Clifford C. Dougherty, III

[57] ABSTRACT

The present invention provides a single trip system for placing perforating apparatus and sand control equipment in a wellbore. This system includes a casing string equipped with extendible pistons and a pumpable activator plug for extending the pistons. Additionally, this system utilizes a single gravel-pack and completion tool string. Further, this system includes a means for opening the extendible pistons to fluid flow.

28 Claims, 3 Drawing Sheets

METHOD AND APPARATUS FOR WELLBORE SAND CONTROL

This is a continuation of application Ser. No. 08/224,605 filed on Apr. 7, 1994, abandoned.

This invention pertains to a system for combining well completion operations to save trips into the wellbore and more particularly to combining sand control and perforating functions which provides a unique completion system.

BACKGROUND

Throughout the world, increased emphasis is being placed on proper initial well completion as the value of non-renewable oil reserves increases and cost of remedial work sky rockets. Maximum reliability and productivity are particularly essential offshore and in remote locations. These objectives are difficult to obtain where formation sands are unconsolidated or otherwise subject to failure. Sand control problems are most common in younger, tertiary sediments. However, sand inflow can occur in other formations if existing insitu stresses are altered by drilling and/or completion operations such that the rock matrix is weakened by movement of the borehole wall.

Sand flow from unconsolidated formations is controlled through chemical or mechanical means to prevent or correct various problems, the most common of which is premature failure of artificial lift equipment. Other potentially serious and costly problems include production loss caused by sand bridging in casing, tubing and/or flow lines; failure of casing or liners from removal of surrounding formation, compaction, and erosion; abrasion of downhole and surface equipment; and handling and disposal of produced formation materials.

Experience indicates sand control should be installed before the reservoir rock is seriously disturbed by sand removal. And it becomes more difficult to control further sand flow as the volume of produced sand increases. Thus, it is not surprising that initial sand control installations prove to be far more successful than remedial treatments. It is also fairly common for remedial installations, for a number of reasons, some of which are not fully understood, to impair productivity.

Sand control methods may be classified as mechanical bridging installations such as gravel-packs, slotted liners or prepacks, consolidated gravel, etc. or consolidation by injection of chemicals into the formation to provide insitu, grain to grain cementation. The simplest, most consistently reliable approach to sand control is application of mechanical sand retention devices. Screens, slotted liners, prepacked liners, and gravel are being used. An important design consideration is the proper sizing of liner openings or gravel pore space relative to the size of producing formation particles.

Gravel-packs are widely applied in wells that are cased and perforated through multiple and/or thin productive sections, or where it is necessary to exclude interbedded water, gas, or undesirable shale streaks. Important advances in the application of gravel-packs has significantly reduced failure frequency and improved productivity of the inside casing gravel-pack. These major advances are the results of improved perforation clean up practices, better use of completion fluids, and application of smaller gravel sizes.

For gravel-pack it is necessary to squeeze fluids into the formation during gravel placement to fill perforation tunnels with compacted gravel. Other perforations will be nonproductive if their tunnels fill to some degree with formation sand during production. In a two-stage gravel-pack, the first stage involves the application of squeeze pressures to force gravel into and outside the perforation tunnel. The second stage normally consists of circulating gravel into place in the screen casing annulus, allowing gravel to be strained from excess carrier fluid as the fluid passes through the screen and returns to the surface.

The two most common techniques for controlling sand production are gravel-packing and sand consolidation. Sand consolidation is a technique wherein after perforating, some type of a liquid consolidation resin is pumped into the perforations to make each sand grain bond to other sand grains with which it is in contact. This leaves a consolidated sandstone formation which will not produce sand. The consolidation treatment to be effective must not greatly reduce the permeability of the previously unconsolidated formation. Also, to be effective every perforation must accept the consolidation resin and consolidate the sand around the perforation tunnel. If even one perforation does not accept resin then that perforation causes the well to produce sand and the treatment will have to be performed again. Normally, after perforating underbalanced, some type of a heavy fluid is placed in the well to prevent the well from flowing. When this is done the fluid damages the sand near the perforations. If the damage is severe, then no fluid will enter the damaged perforations. Afterwards, when the consolidation treatment is performed, some of the perforations will take fluid and others will not, which leads to an unsuccessful consolidation treatment.

In a gravel-packing operation, after the well is perforated, a screen is placed inside of the well that is across from all of the perforations. This screen has a diameter which is smaller than the inside diameter of the casing. Gravel is placed between the perforations and the screen. The gravel is of such a diameter that the formation sand will not be able to flow through it. The gravel placed in the well bore is of such a size that it will not be able to flow through the screen. This prevents sand production, yet oil or gas can still be produced through the gravel and the screen.

Conventional perforating techniques require that the well be perforated and then killed with heavy clean, clear brines while the perforating guns are removed from the hole. This process takes time and the brine normally reduces the productivity of the well because it damages the permeability of the formation. Present techniques exist whereby perforating and gravel pack can be accomplished in a single well trip. Such conventional single trip perforating/gravel-packing methods run standard gravel pack equipment and tubing conveyed perforating guns at the same time on the same work string. The tubing conveyed perforating gun is attached below the gravel-pack equipment. The conventional system is operated as follows: (1) The assembly is lowered into place so that the tubing conveyed perforating guns(s) are located across the zone to be perforated, (2) a firing head is activated by one of several triggering methods, (3) the firing head causes the perforating gun to fire, perforating the formation (4) formation fluids flow into the wellbore, if the formation has been perforated in an underbalanced pressure condition,(5) the perforating gun is disconnected from the gravel-pack equipment and drops to the bottom of the wellbore (6) the gravel-pack equipment is placed across the perforated zone by: (a) killing the well with an appropriately weighted completion fluid to isolate the rig floor from the reservoir pressure and lowering the gravel-pack equipment into position, or by (b) lowering the gravel-pack equipment into position using time consuming snubbing procedures and controlling reservoir pressure on the rig floor (7) Conventional gravel-pack procedures are then implemented.

While imperative to good well completion, proper cementing is one of the most difficult completion phases. Conditions are particularly severe in deviated holes in which casing may be off center. Perforating debris and mud pockets at the cement-formation interface can prevent uniform sand control placement. Completion fluids can cause impairment due to deep bed invasion by entrained solids or dispersion of formation water/sensitive clays, as with mud filtrates. Damage also can occur if the completion fluid is not properly designed and large volumes of bridging materials are lost to the formation.

It is therefore an object of the present invention to provide a new and improved completion system that provides for a well completion using sand control techniques and not requiring killing of the well or snubbing to perform the sand control operation.

In addition, it is an object of this invention to provide a completion system for perforating or opening flow channels into a formation and performing sand control operations in the wellbore, all in one trip into the well.

SUMMARY OF THE INVENTION

With this and other objects in view the present invention involves placing perforating or flowport apparatus in the wellbore and then prior to operating the perforating or flowport apparatus, installing sand control equipment such as a gravel-pack screen.

A single trip system for accomplishing this is to run casing pipe into the wellbore wherein the casing pipe has extendible normally closed flowports which may include perforating charges. A gravel-pack screen is installed opposite the flowports prior to opening the flowports and/or perforating the formation. After perforating, a sand control operation is conducted without killing the well.

This completion system further involves a single trip completion wherein extendible cylinders are retractably positioned transversely in the casing pipe wall while the casing is being run into the well and then extended and locked in place to effectively centralize the casing in the wellbore to optimize cementing of the casing string. The cylinders can contain shaped charges or other materials for use in the completion of the well. A sand control tool is then run into the well on a tubing string and includes a pressure wave generating device for initiating an explosive in the pistons as a part of the completion operation. This sand control tool and pressure wave generating device which is used to initiate explosive devices, can be run in the well on a single tubing string run so that the sand control tool as well as any sand screens or the like are in place and no further operations are performed which require the well to be killed or snubbing operations to be conducted.

DETAILED DESCRIPTION OF THE INVENTION

Figure 1:
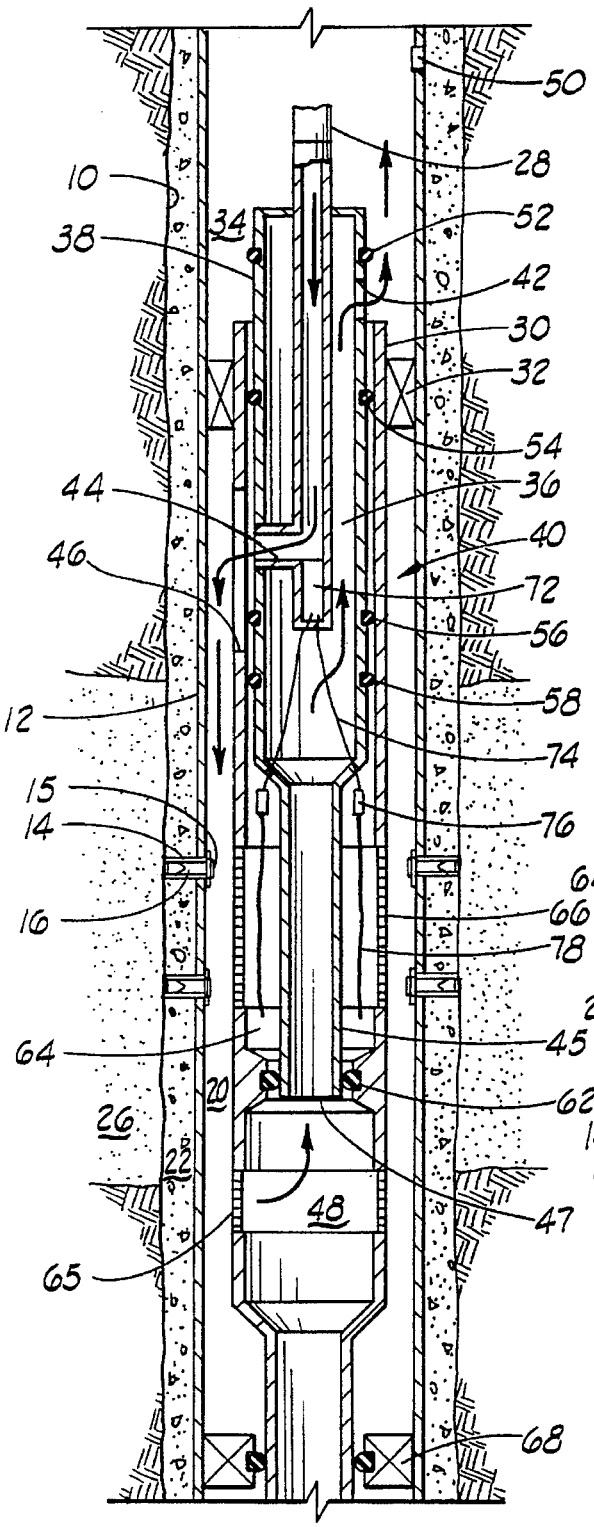
FIG. 1 is a schematic elevation view of a wellbore showing a completion system in accordance with the present invention prior to perforation of the formation to be produced.

A well completion system is shown in FIG. 1 including a casing pipe string 12 positioned in a wellbore 10 which has been drilled into earth formations. Extendible pistons 14 are shown projecting outwardly from the casing pipe. These pistons and their use are described in detail in U.S. Pat. No. 5,228,518, and PCT patent application Nos. PCT/US93/09685, PCT/US93/09688, PCT/US93/09648 AND PCT/US93/09689, which are incorporated herein by reference. The pistons 14 are shown having explosive charges 16 positioned in the bore of the piston to provide a normally closed flowpath through the piston, which upon detonation of the explosive charge 16, will be opened. A detonator 15 is positioned in the inner end of the piston for initiating the explosive charge. While the pistons 14 in FIG. 1 are shown to have an explosive charge for opening a flowport or for perforating, the pistons also serve as casing centralizers when extended. Thus, pistons on the casing above and below the completion zone would not normally have an explosive charge.

Figure 2:
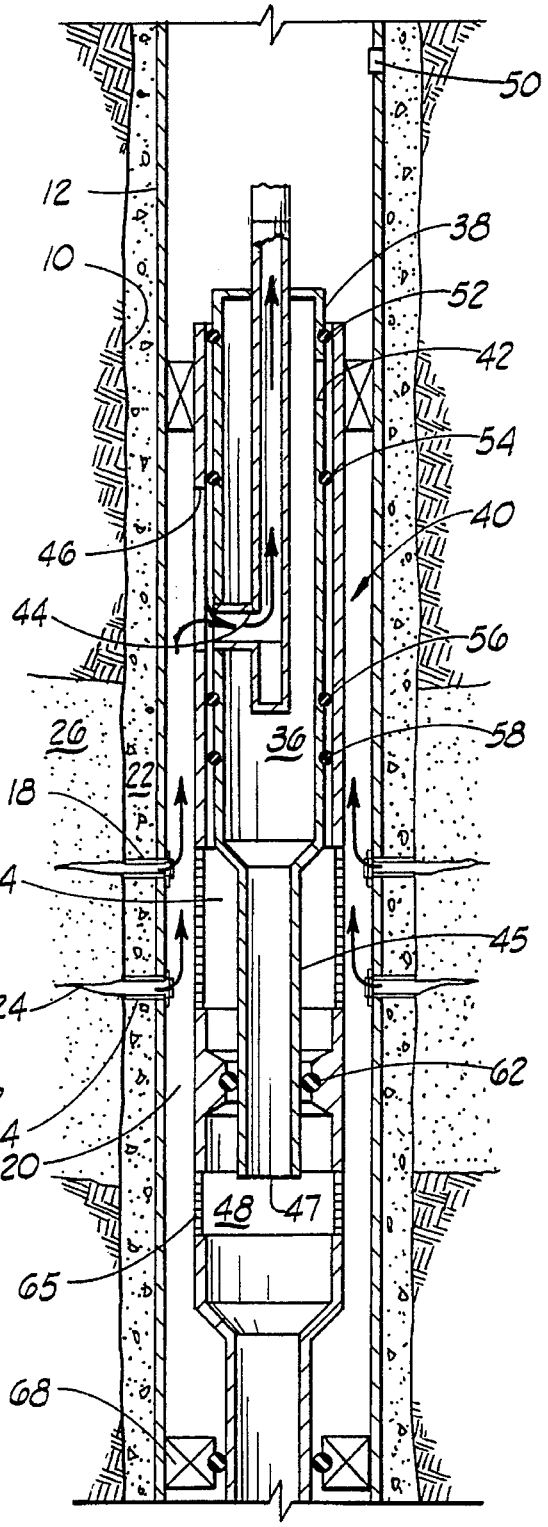
FIG. 2 is a schematic view of the wellbore completion system of the present invention after perforating.

The pistons 14 are arranged to be extended from the casing 12 after the casing is positioned in the wellbore. When extended, the pistons serve to centralize the casing string in the wellbore prior to cementing. Thus, when explosive charge 16 is activated and the pistons are opened, a flowpath 18, as shown in FIG. 2, is provided from the interior bore 20 of the casing pipe string through cement 22, in the annulus between the casing 12 and the wellbore 10. When the explosive charge 16 is a shaped charge or the like, a perforation 24 is formed in the formation 26. The explosive energy from the shaped charge 16 does not have to penetrate the casing 12 or the cement 22 but instead is directly applied, when activated, to the formation 26 to thereby maximize the benefit of the explosive energy toward penetration of the formation.

Once the wellbore is cased, centralized, and cemented, a completion tool string 40 is shown extended into the casing. The tool string 40 may be run into the wellbore on a tubular member 28 such as a tubing string, production pipe string, coiled tubing string, or the like. The completion string is comprised of a gravel-pack tool having an outer housing 30. A top packer 32 is positioned on the gravel-pack tool. When activated, the packer closes off an annular space 34 between the tool string and the interior wall of the casing pipe string 12. The tool 40 includes a ported upper chamber 36 which is provided by a tubular mandrel 38 movably mounted within the housing 30. An upper port or passage 42 is formed in the outer wall of mandrel 38 and provides a flowpath between the annular space 34 outside of the tool 40 and the chamber 36 therein. A lower port 46 forms a selectively operable flowpath between the interior of tubing string 28 and the exterior of the gravel-pack tool 40. A passage 44 in the outer housing 30 provides a flowpath between the bore 20 of the casing string, below packer 32, and the tubing string 28 through the gravel-pack tool 40. The bottom end of mandrel 38 is provided with a smaller diameter tail pipe portion 45 having an opening or passage 47 to provide a flowpath into the chamber 36 from a lower chamber 48 that is formed between the lower end of mandrel 38 and the lower end of outer housing 30.

A series of sealing members are positioned on the tool 40 to permit selective opening and closing of the ports 42, 46 and 47 when the mandrel 38 is selectively moved longitudinally within the outer housing 30. This selective movement feature may be provided by the incorporation of J slot devices or the like on the tool 40 (not shown) to provide for selective operation or movement of the mandrel 38 in response to combinations of raising, lowering, or rotation of tubular member 28. Upper sealing members 52, 54 are respectively positioned above and below the port 42 in mandrel 38 and seal between the mandrel 38 and housing 30 to open and close port 42 to fluid flow. Lower sealing members 56, 58 likewise seal off the space between mandrel 38 and housing 30 below lower passage 44 and port 46. A bottom seal 62 is positioned between the housing 30 and the tailpipe 45 at the lower end of mandrel 38 to close off passage 47. This forms an intermediate chamber 64 between housing 30 and mandrel 38 by bottom seal 62 and lower seals 56, 58.

At the lower end of the tool housing 30 a tell-tale screen 65 is provided in the housing 30 wall to permit screened fluid flow, over a smaller section between the casing bore 20 and lower chamber 48. This in turn permits fluid flow through passage 47 into the chamber 36 within mandrel 38. A larger section of gravel-pack screen 66 is positioned above the tell-tale screen 65 and above bottom seal 62. The larger screen may be made of several sections of pipe, depending on the interval to be perforated or completed. In any event such section of gravel-pack screen would be interposed in the tool string at a location opposite the formation to be produced. Thus, the gravel-pack screen 66, as positioned, forms the outer wall of the intermediate chamber 64 in the tool 40 to selectively provide an opening for fluid flow passage between casing bore 20 and intermediate chamber 64. A sump packer 68 may be provided between the casing string and the lower end of the gravel-pack tool 40 to serve as a base for the gravel-pack. The sump packer can be run on the tool string or set beforehand by wireline or tubing. Produced fines can fall through the packer 68 into the lower end of the tool string after they pass through the screen 66 during production or shut down periods, to prevent buildup.

A radioactive or magnetic marker 50 or the like can be positioned in the casing string to provide an indication of proper positioning of the gravel-pack tool 40 relative to the pistons 14 in the casing. Thus, the gravel-pack can be accurately positioned opposite the perforations or flow ports to be provided in the casing to produce the formation 26. Detection means (not shown) are provided on the tool 40 to detect the marker 50 and thus provide a surface indication of the position of tool 40 in the casing string.

Again referring to FIG. 1, a system is shown for actuating the normally closed flowports in the pistons 14 to open the flowports and/or detonate shaped charges 16 positioned in the pistons. Patent applications PCT/US93/09685, PCT/US93/09689, PCT/US93/09648, and PCT/US93/09688 describe in detail how the pistons are extended and how the detonation of explosives in the pistons can be initiated. These applications are incorporated by reference. The explosive initiating system used in the present system includes a firing head 72 which is placed in the gravel-pack tool string so that it may be actuated from the surface. This actuation of the firing head may be accomplished, for example, by dropping a bar to impact the head, by increasing pressure in the tubing string 28 to hydraulically actuate the firing head 72 or by electrical means extending from the surface. Such actuating schemes are well known in the art. In the present system, the firing head 72 is arranged to send an electrical impulse, when actuated, through wires 74 to blasting caps 76. The blasting caps 76, when activated, initiate the firing of a detonating cord 78 such as that sold under the tradename "PRIMACORD". When the detonating cord is initiated, it generates a pressure wave which will be propagated through fluid in the intermediate chamber 64 and casing interior 20 into contact with the pistons 14. A detonator 15 in the pistons is activated by the pressure wave. The detonator 15 in turn, when activated, initiates an explosive charge 16 in the piston 14, such as a shaped charge. The explosive charge, when activated, opens the flowport 18 in the piston to fluid flow. When the explosive charge 16 is a shaped charge, the shaped charge will, when activated, perforate into the formation 26 to provide perforations 24 (FIG. 2).

In the completion of a well in hydrocarbon bearing formations, the well may be cased or completed open hole. When a casing is used in the completing process, the sequence of events would normally involve running the casing string to completion depth opposite the formation to be completed and then cementing the casing. A perforating gun is then run into the casing and fired to open a perforation passage from the interior of the casing through the casing wall and cement, and then into the formation to be produced. If the well is to be completed without further operations the well may then be opened into a tubing string to produce fluids to the surface. This initial production serves to clean out the perforations and any contamination by fluids or debris when the perforating is performed. If subsequent completion techniques are applied such as gravel-packing, the well is normally killed, if this was not already the well condition prior to perforation, by using a dense liquid which provides a sufficient hydrostatic head to overbalance the formation pressure. This overbalance may cause damage to the formation and reduce the production potential of the well. In any event, the wellbore-to-formation pressure relationship at the time of perforating may be overbalanced, balanced, or underbalanced.

Where sand control is needed it can be assumed that there is not a permanent open perforation channel within the formation beyond the cement sheath. Nor will a perforation tunnel or flowport through cement and casing wall be void of packing material. Perforation tunnels through cement can be a source of high pressure drop if formation sand enters the perforation tunnel and is restrained by an inside gravel-pack or screen. Experiments also show that flow through tunnels can be turbulent, causing pressure drops to be far greater than that predicted by Darcy, Laminar-flow equations. This problem is sometimes attended to by increasing perforation density and/or diameter. Special guns capable of providing large diameter perforations in the range of 0.75 to 1 inch are sometimes used. In the present system, the flow tunnel diameter can be adjusted up to say 1.25 inches in diameter if larger or thicker walled casing is used to provide a greater wall thickness and thus support a larger diameter piston. Larger flowports and larger quantities of flowports will give less choking effect and improve productivity. The clean nearly round flow tunnels of the present invention will also help in getting sand control material into the perforations to thereby improve productivity.

Reverse pressure (underbalanced) perforating is generally recommended for natural completion. The objective is to create a potential pressure differential between the formation and the wellbore interior so that the initial flow is towards the wellbore. With adequate differential, perforation debris is flushed out of the perforation channel and tunnel. Underbalance perforating requires the well to be under control during perforating so that fluid inflow can be handled safely and perforating equipment can be removed if needed. Presently, two perforating systems are available for underbalanced perforating and flowing wells:

(1) through-tubing guns run on wire line to perforate below a packer, and (2) tubing-conveyed guns run below the packer.

Wire line through-tubing guns must be smaller in diameter than the tubing i.d. In small sizes, more than four holes per foot must be obtained by reshooting the same interval. Small guns present centering problems in the larger casing. And, in strongly flowing wells, the guns can be blown up hole if the cable size and selected underbalance is not properly coordinated.

Tubing conveyed guns can be made up in long lengths to perforate a long zone. However, very long zones may require more than one tubing trip to perforate the entire zone. The guns are fired by dropping a bar onto the firing head located above the gun section below the production packer.

A positive pressure perforating simplifies well control because fluids inside the casing overbalance the formation pressure and prevent inflow. However, this also holds gun debris and crushed rock in the perforation, necessitating an additional clean out operation. For sand control, further clean out is imperative prior to gravel-packing or injecting consolidating chemicals. Without tubing in the well, similar guns can be run on wire line as would be used for tubing conveyed methods.

In the application of the present system to a well completion, the following sequence can be used. After the well is drilled to completion depth, a casing string 12 such as shown schematically in FIG. 1 is run into the wellbore 10. The casing string is equipped with extendible pistons 14 such as described in U.S. Pat. Nos. 5,228,518 and 5,224,556. After the casing string is run to the proper depth wherein flowports or perforators are positioned opposite the formation to be produced, the pistons 14 are extended to centralize the casing string. A pumpable activator plug, as shown in Pat. No. PCT/US93/12440 and incorporated herein by reference, can be used to extend the pistons from the casing string. After the casing is set and centralized at the proper depth, the casing will normally be cemented. After the cement has set, the gravel-pack and completion tool string 40 shown in FIG. 1 is run into the well on a tubing string 28. The tool string is positioned in the casing so that the gravel-pack screen 66 is opposite the pistons 14 having flowports or perforators. As shown in FIG. 1 the tool assembly 40 is in an open circulating position wherein the mandrel 38 is raised upwardly relative to housing 30 to open the port 42 in the mandrel 38. Fluid-flow passages 46 and 44 are also in communication so that fluids can be circulated from the surface through pipe string 28, through passage 44 and port 46 into the casing bore 20 below top packer 32, which is now set to close off the casing above the tool 40 when port 42 is closed. These circulating fluids can then pass through telltale screen 65 and opening 47 at the bottom of the mandrel 38 for passage up through chamber 36 in the mandrel to exit through port 42 and thereby recirculate through the tubing-casing annulus to the surface. If the well is to be completed underbalanced, this circulating fluid will be light enough to not present a hydrostatic head greater than the formation pressure.

When the wellbore fluid density is properly established, the completion tool 40 is operated to close port 42 by lowering the tubing string 28 and thus lower the mandrel 38 relative to outer housing 30. This moves upper seal 52 into contact with the inside of housing 30 to close off the port 42 and thus prevent the circulation of fluids up the casing-tubing annulus. In this tool condition, fluids will not flow through the screens 65 and 66, in that chambers 36, 64 and 48 are not open to a fluid flow passage to the surface. The wellbore is then perforated. An appropriate mechanism is utilized to operate the firing head 72, such as a drop bar (not shown). Upon operation of the firing head 72, an electrical impulse, or the like is generated by the firing head and passed by wires 74 to initiate the blasting cap 76. Activation of the blasting cap will then initiate the detonating cord 78 which in turn will generate a pressure wave that will be propagated by fluid in the wellbore and in the completion tool 40. This propagated pressure wave will pass through the screen 66, in the disclosed configuration, to impinge on the inner end of pistons 14. A detonator 15 in the inner end of the pistons is activated in response to the pressure wave to initiate the explosive charge 16 in the pistons. The explosive charge will open the piston to fluid flow, thus providing an open flowport and will perforate the formation as at 24 (FIG. 2) when the charge is so designed.

Upon perforation of the formation and/or opening of flowport 18, formation fluids under formation pressure are permitted to flow into the casing bore 20 as shown in FIG. 2. The port 46 is open to permit fluids to flow into the passage 44 and from there into the tubing string 28 for passage to the surface. This flow of formation fluids after perforation, permits the perforations to be cleaned of debris. Underbalanced perforating usually conducted by using tubing conveyed perforators, helps prevent damage caused by wellbore fluids entering the sand bearing zone. However, prior to the present technique, once the well is perforated, the tubing carrying the charges is usually removed from the well or moved within the well to position gravel-packing apparatus. This requires, in most cases, that a clear, clean, brine be placed across the perforations to control well pressure and/or minimize damage to the producing zone. Some damage still occurs and these fluids are expensive to install. Once the gravel-pack apparatus is positioned across the zone to be produced, gravel is pumped into the well. Once the gravel-pack is performed, the gravel-pack tubing is typically removed from the well and a production tubing string is run into the well. By combining the gravel-pack and perforating steps into a single run of tubing into the well, much time and money are saved, especially in offshore operations where daily rig costs may be extremely high. Once the gravel-pack screen is in place, the perforators are fired, and the sand is placed, all without additional trips into the wellbore. The sand could also be in place in the annulus between the screen and pipe when the perforators are fired. Thus, whatever media is in place in this annulus will carry the shock wave of the detonating cord 78 to the detonator 15 on the piston 14. Normally, the gravel is positioned in the gravel-pack after the perforations are allowed to flow or take fluid. The present system allows many alternative completion schemes. The pistons leave a clean flow tunnel which is almost perfectly round which will help to get sand into the perforations. This prevents the perforations from collapsing and improves production. The use of the present technique may also eliminate killing the well and thus the use of expensive brines, which also minimizes formation damage to improve production.

When used with sand consolidation, the present technique can be used in an underbalanced system to pump a consolidation resin into the perforations, after perforating, without having to kill the well. Additionally, a consolidated permeable plug (not shown) can be positioned within the pistons. The pistons can be opened by a pump down device or chemically opened such as by acid to open a flowport with a permeable plug inside the flow tunnel. These plugs would prevent formation sand from entering the wellbore. Acid or other stimulating fluids could be pumped through the permeable plug in the flow tunnels.

When perforating takes place underbalanced, the perforations clean out naturally before other materials or fluids are forced through the perforations into the formation. Alternatively, an overbalanced pressure can be maintained across the formation during this perforating step, such that when the charges 16 are fired, net flow is into the formation. The fluid in the wellbore that flows into the formation can be an acid, a foamed acid, or some other type of fluid designed to clean up the perforations. Assuming some type of clean pad is initially across the perforations, the pad can be followed by gravel or a consolidating resin. An expanding gas cap can be placed on the wellbore to extend the overbalanced pressure.

Figure 3:
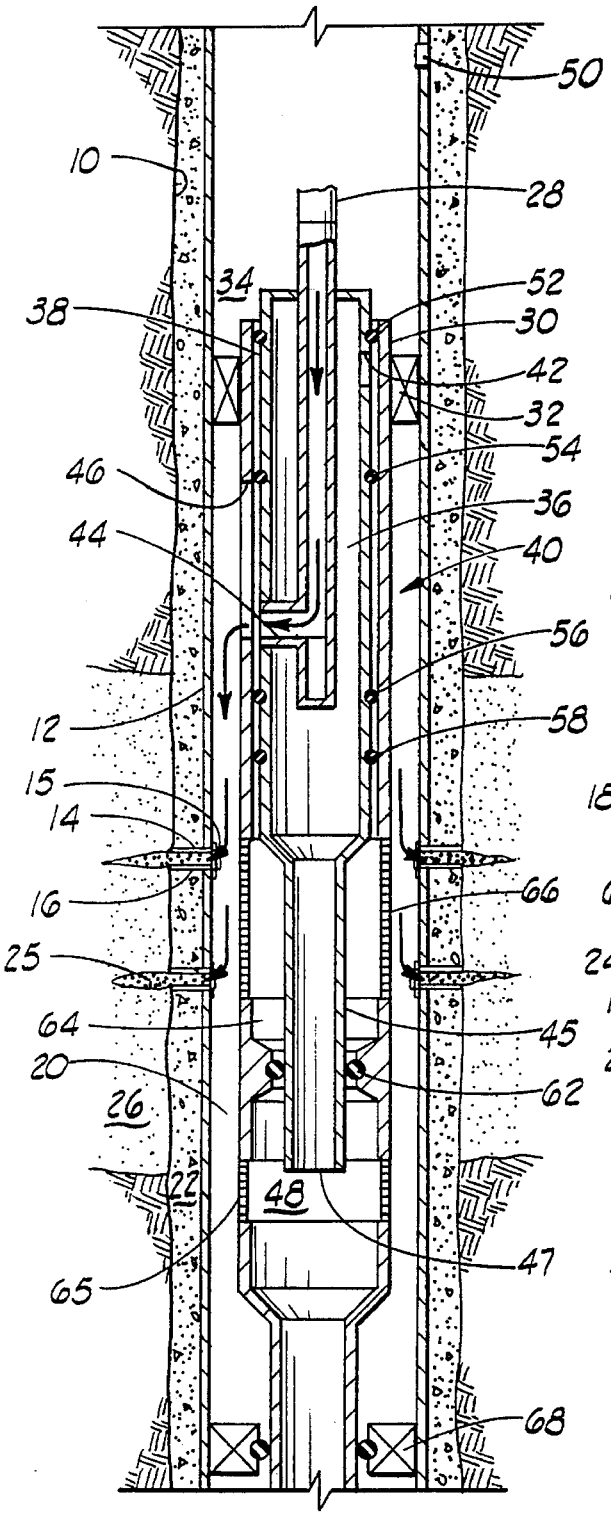
FIG. 3 is a schematic view of the wellbore completion system of the present invention illustrating sand being squeezed into perforations.
Figure 4:
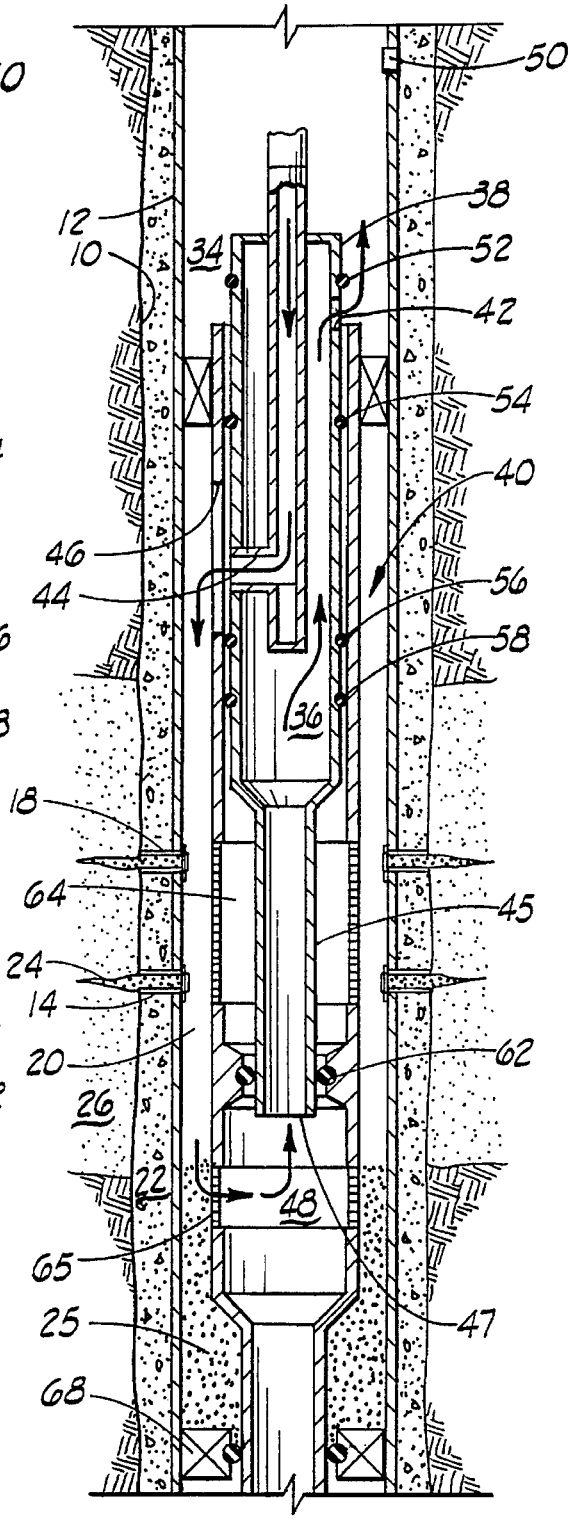
FIG. 4 is a schematic view of the wellbore completion system illustrating circulating gravel across a tell-tale screen.
Figure 5:
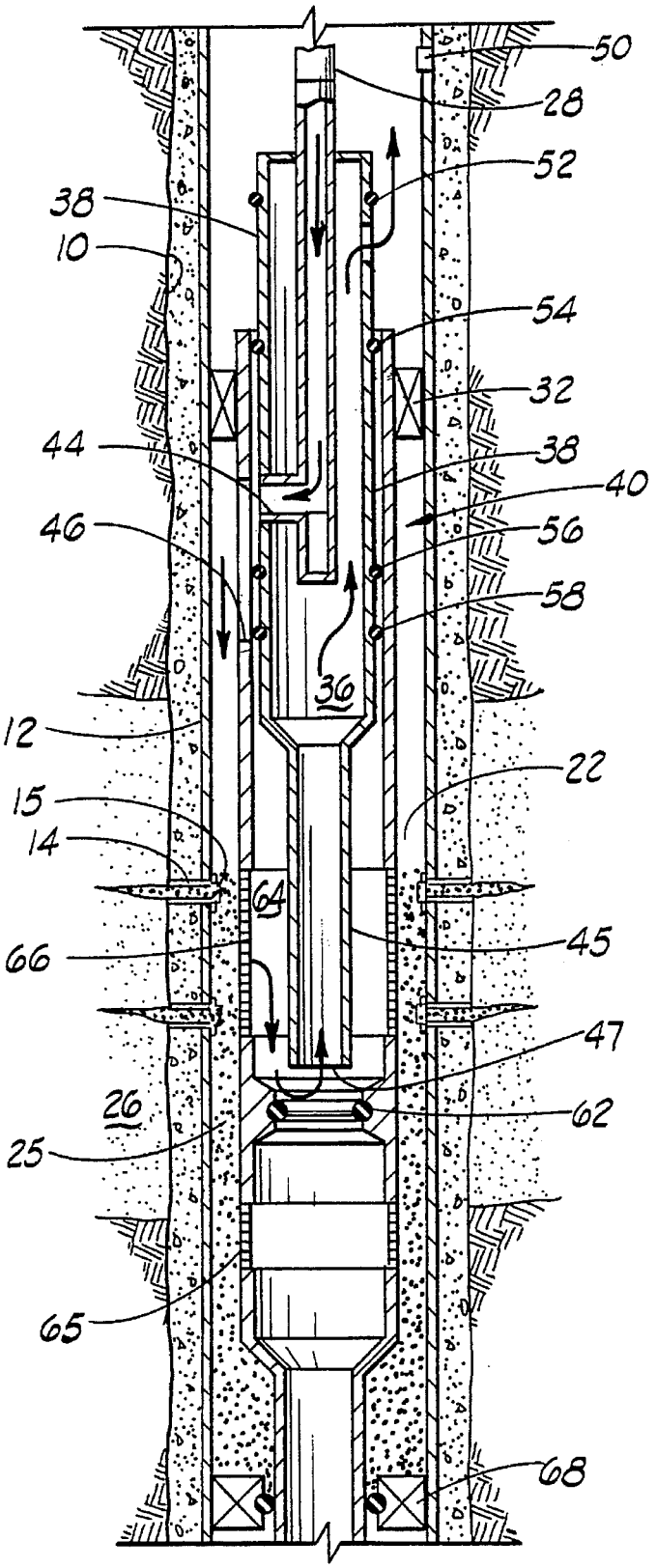
FIG. 5 is a schematic view of the wellbore completion system showing gravel being circulated across a gravel-pack screen.

Referring next to FIG. 3, the fluid flow in the system is reversed and gravel or sand 25 is pumped into the well. The two stage gravel-pack system shown permits for spotting and squeezing sand laden fluids into the perforations in a first stage. The gravel flow may be continued until the tell-tale screen is covered. This can be checked by shifting tool mandrel 38 upwardly to open port 42 as shown in FIG. 4. If the tell-tale screen is covered with gravel, pressure will develop in the system. These steps of pumping the gravel-pack and checking the level until it covers the tell-tale screen are repeated until the tell-tale screen 65 is covered with sand 25 as shown in FIG. 4. When this occurs, the tool 40 is then operated to raise the mandrel 38 to a yet higher position which maintains port 42 open as shown in FIG. 5 and also raises the tail pipe portion 45 at the lower end of mandrel 38 above seal 62. This in turn opens the bottom chamber 48 of the tool to communication with the intermediate chamber 64 opposite the gravel-pack screen 66. Thus, in a second stage of operation, the gravel-pack material which has been previously pumped into the wellbore to cover the tell-tale screen 65 can now circulate through screen 66 and thence through opening 47 at the bottom of tailpipe 45, upwardly through chamber 36 and port 42, into the tubing-casing annulus 34 above packer 32. This circulation mode of the tool in FIG. 5 permits the gravel-pack to be circulated to completion. The mandrel 38 can then be manipulated to be pulled from the housing 30.

An important design consideration in a gravel-pack is the proper sizing of the screen or liner relative to the producing formation particles. Restraint is provided by properly sizing gravel pore openings relative to the sand particle diameter. Other factors such as gravel characteristics, screen construction, etc., are extremely important. Gravel-packing is an effective sand control when placed over the producing zone between the formation and a production string.

The single trip gravel-pack system of the present invention consists of modified standard gravel-pack equipment and casing conveyed perforators. In this system gravel-pack equipment is modified to contain the primacord required to detonate the perforators. Appropriate modifications are made to protect the gravel-pack screen from damage when the primacord is fired. The system is utilized as follows:

1. The casing conveyed perforators are run on the production casing or liner and positioned across the formation to be perforated. The perforators are activated and the casing is cemented and prepared for completion.
2. The modified standard gravel-pack equipment is lowered into position across the formation to be perforated.
3. A firing head is activated by one of several triggering methods, setting off a chain reaction that detonates the primacord to form a pressure wave, fires the detonators, and activates the shaped charges. The shaped charges perforate the formation.
4. Formation fluids flow into the wellbore and up the workstring, if the formation has been perforated in an underbalanced pressure condition.
5. Flow is reversed by pumping gravel slurry down the workstring and into the perforations. The gravel-pack tools are shifted as necessary until all gravel is circulated into place. Unlike the conventional single trip system, the new capability can be used in wellbores of any angle since there is no perforating gun that has to be disconnected and dropped to bottom. Conventional systems cannot be used in wells exhibiting angles greater than 60°.

While the term gravel-pack is used extensively throughout this application to describe and claim the invention, this term is used generically to include any packing material whether it be sand, gravel or various other filtering materials such as aluminum materials, anthracite, glass, etc. Likewise, the term screen herein should be considered to represent any sort of slotted liner, screen, prepacked liner, etc.; when they are used for sand control or to restrain gravel-pack gravel. In addition, a variety of techniques can be used to carry out the gravel-pack and sand control operations. This description has only covered a small range of the possible combinations of operations that can be performed to accomplish the completion system that is covered by this invention.

Therefore, while particular embodiments of the present invention have been shown and described, it is apparent that changes and modifications may be made without departing from this invention in its broader aspects, and therefore, the aim in the appended claims is to cover all such changes and modifications as fall within the true spirit and scope of this invention.

We claim:

1. A wellbore completion system for preparing a wellbore transversing earth formations to produce formation fluids to the surface, comprising:

a casing pipe string positioned in the wellbore adjacent a formation to be produced;

a smaller pipe string extending within the casing pipe string from the surface of the wellbore to the vicinity of the formation to be produced;

at least one flowport positioned in the wall of the casing pipe string for providing a flowpath between the interior bore of the casing pipe string and the outside surface of the casing pipe string adjacent the formation to be produced, said flowpath being normally closed to fluid flow;

sand control means positioned on said smaller pipe string across the formation to be produced; and means actuated from the surface for opening said flowpath to fluid flow between the formation to be produced and the interior bore of the casing pipe string, said flowport and said sand control means having operating positions relative to one another such that said sand control means is in operating position across the formation to be produced at the time said flowpath is opened to fluid flow between the formation to be produced and the interior bore of the casing pipe string.

2. The wellbore completion system of claim 1 wherein said sand control means is comprised of a gravel-pack tool including a screen for holding sand control material in place between the tool and said flowport.

3. The wellbore completion system of claim 2 wherein said gravel-pack tool includes selectively operable valve means operable in a first mode to permit fluid flow from the formation to be produced into the smaller pipe string and operable in a second mode to permit sand control material to flow from the smaller pipe string into a space between said screen and said flowport.

4. The wellbore completion system of claim 1 wherein said means for opening said flowpath includes an explosive device positioned on said smaller pipe string.

5. The wellbore completion system of claim 1 wherein said means for opening said flowpath includes an explosive charge positioned in said flowport for opening said flowpath when actuated and a pressure wave generating device positioned in the vicinity of said flowport but spaced therefrom so as not to be in direct contact with said explosive charge for initiating said explosive charge.

6. A wellbore completion system for preparing a wellbore transversing earth formations to produce formation fluids to the surface comprising:

a casing pipe string positioned in the wellbore adjacent a formation to be produced;

extendible pistons positioned in the wall of said casing pipe string for providing selectively openable flowpaths between the interior bore of said casing pipe string and the outside surface of said casing pipe string adjacent the formation to be produced and serving to center said casing pipe string in the wellbore when extended;

perforating charges positioned in said pistons for opening said flowpaths to fluid flow between the formation to be produced and the interior bore of said casing pipe string when actuated;

a tool string suspended in the wellbore on a tubing string;

sand control means positioned on said tool string opposite said pistons;

means positioned on said tool string for actuating said perforating charges and opening said flowpaths to fluid flow between the formation to be produced and the interior bore of said casing pipe string.

7. The wellbore completion system of claim 6 wherein said sand control means includes a screen for holding sand control material in place between said tool string and said pistons.

8. The wellbore completion system of claim 7 wherein said sand control means includes selectively operable valve means operable in a first mode to permit flow from the formation to be produced into the tubing string and operable in a second mode to permit sand control material to flow from the tubing string into a space between said screen and said pistons.

9. The wellbore completion system of claim 6 wherein said means positioned on said tool string for actuating said perforating charges and opening said flowpaths to fluid flow includes a pressure wave generating device.

10. A method of completing a wellbore drilled from the earth surface into an earth formation to be produced, comprising the steps of:

positioning a casing pipe string in the wellbore adjacent the formation to be produced, wherein said casing pipe string has at least one piston positioned in the wall of the casing pipe string and said piston has a selectively openable flowpath extending through said piston to allow fluid flow between the interior bore of the casing pipe string and the outside surface of the casing pipe string adjacent the formation to be produced;

positioning a smaller pipe string having sand control apparatus positioned thereon inside said casing pipe string such that said sand control apparatus is positioned across the formation to be produced;

after said sand control apparatus is positioned across the formation to be produced, performing a remote operation at the surface to open said flowpath to fluid flow between the formation to be produced and the interior bore of said casing pipe string; and carrying out a sand control operation with said sand control apparatus.

11. The method of claim 10 further including the step of placing the wellbore in an underbalanced condition prior to opening said flowpath to fluid flow.

12. The method of claim 10 wherein said smaller pipe string has an explosive device positioned thereon in the vicinity of said sand control apparatus and spaced from said piston, said piston includes a perforating charge therein which when detonated opens said flowpath and perforates the formation, and said step of performing a remote operation at the surface to open said flowpath includes operating said explosive device to initiate detonation of said perforating charge.

13. The method of claim 12 wherein said explosive device includes a pressure wave generating device and said perforating charge is detonated in response to a pressure wave generated by operation of said pressure wave generating device.

14. The method of claim 10 wherein said step of carrying out a sand control operation with said sand control apparatus includes placing a gravel-pack in the wellbore after said flowpath is opened to fluid flow.

15. The method of claim 10 wherein said step of carrying out a sand control operation with said sand control apparatus includes placing a consolidating resin into said wellbore under pressure after said flowpath is opened to fluid flow.

16. The method of claim 10 further including the step of placing the wellbore in an overbalanced pressure condition prior to opening said flowpath to fluid flow.

17. The method of claim 16 further including the step of after opening said flowpath to fluid flow, placing a perforation clean-up material in the wellbore under pressure.

18. The method of claim 16 wherein said wellbore is placed in an overbalanced pressure condition by placing a gas cap in the wellbore.

19. The method claim 10 further including the step of after opening said flowpath to fluid flow, forcing acid material in the wellbore under pressure.

20. A method of preparing a wellbore transversing earth formations to produce formation fluids to the surface comprising the steps of:

providing extendible pistons in the wall of a casing pipe string, wherein at least some of said pistons have selectively openable flowpaths for providing flowpaths between the interior bore of the casing pipe string and the outside surface of the casing pipe string when extended;

positioning said casing pipe string in the wellbore such that said pistons with selectively openable flowpaths are positioned opposite a formation to be produced;

extending said pistons to center said casing pipe string in the wellbore;

positioning a smaller pipe string having sand control apparatus thereon inside said casing pipe string such that said sand control apparatus is positioned opposite said pistons with selectively openable flowpaths;

after said sand control apparatus is positioned opposite said pistons with selectively openable flowpaths, performing a remote operation at the surface to open said flowpaths to fluid flow between the formation to be produced and the interior bore of said casing pipe string; and carrying out a sand control operation with said sand control apparatus.

21. The method of claim 20 further including the step of after extending said pistons and prior to positioning said smaller pipe string inside said casing pipe string, cementing said casing pipe string in the wellbore.

22. The method of claim 20 wherein said smaller pipe string has an explosive device positioned thereon in the vicinity of said sand control apparatus and spaced from said pistons with selectively operable flowpaths, said pistons with selectively operable flowpaths include perforating charges therein which when detonated open said flowpaths and perforate the formation, and said step of performing a remote operation at the surface to open said flowpaths includes operating said explosive device to initiate detonation of said perforating charges.

23. The method of claim 22 wherein said explosive device includes a pressure wave generating device and said perforating charges are detonated in response to a pressure wave generated by operation of said pressure wave generating device.

24. The method of claim 20 wherein said step of carrying out a sand control operation with said sand control apparatus includes placing a gravel-pack in the wellbore after said flowpaths are opened to fluid flow.

25. The method of claim 20 wherein said step of carrying out a sand control operation with said sand control apparatus includes placing a consolidating resin in the wellbore under pressure after said flowpaths are opened to fluid flow.

26. The method of claim 20 further including the step of placing the wellbore in an underbalanced condition prior to opening said flowpaths to fluid flow.

27. The method of claim 20 further including the step of placing the wellbore in an overbalanced pressure condition prior to opening said flowpaths to fluid flow.

28. A wellbore completion system for preparing a wellbore transversing earth formations to produce formation fluids to the surface, comprising:

a casing pipe string positioned in the wellbore adjacent a formation to be produced;

a smaller pipe string extending within the casing pipe string from the surface of the wellbore to the vicinity of the formation to be produced;

at least one flowport positioned in the wall of the casing pipe string for providing a flowpath between the interior bore of the casing pipe string and the outside surface of the casing pipe string adjacent the formation to be produced, said flowpath being normally closed to fluid flow;

an explosive charge positioned in said flowport for opening said flowpath when actuated;

sand control means positioned on one of said pipe strings across the formation to be produced;

a pressure wave generating device positioned on said smaller pipe string in the vicinity of said flow-port but spaced from said flowport so as not to be in direct contact with said explosive charge for initiating said explosive charge;

means actuated from the surface for activating said pressure wave generating device to initiate said explosive charge and open said flowpath.

* * * * *